US005967886A

United States Patent [19]

Wuensch et al.

[11] Patent Number: 5,967,886

[45] **Date of Patent: *Oct. 19, 1999**

[54] HAND POWER TOOL FOR FLAT MACHINING

[75] Inventors: Steffen Wuensch, Holzgerlingen; Joao Bergner, Aidlingen, both of Germany

[73] Assignee: Robert Bosch GmbH, Stuttgart, Germany

[ * ] Notice: This patent is subject to a terminal disclaimer.

[21] Appl. No.: 08/740,315

[22] Filed: Oct. 28, 1996

[30] Foreign Application Priority Data

Nov. 29, 1995 [EP] European Pat. Off. ..... 95118775

[51] Int. Cl.[6] ..... B24B 23/00

[52] U.S. Cl. ..... 451/356; 451/357; 451/421; 451/441

[58] Field of Search ..... 451/357, 356, 451/421, 441

[56] References Cited

U.S. PATENT DOCUMENTS

| | | | |
|---|---|---|---|
| 3,160,995 | 12/1964 | Danuski . | |
| 3,283,352 | 11/1966 | Hu | 451/357 |
| 4,782,632 | 11/1988 | Matechuk . | |
| 5,301,471 | 4/1994 | Fischer et al. | 451/357 |
| 5,470,272 | 11/1995 | Kikuchi et al. | 451/356 |
| 5,554,066 | 9/1996 | Bosten et al. | 451/356 |
| 5,626,510 | 5/1997 | Berger et al. | 451/357 |

FOREIGN PATENT DOCUMENTS

| | | |
|---|---|---|
| 1938350 | 7/1969 | Germany . |
| 686363 | 1/1953 | United Kingdom . |

*Primary Examiner*—Robert A. Rose
*Assistant Examiner*—George Nguyen
*Attorney, Agent, or Firm*—Michael J. Striker

[57] ABSTRACT

A hand power tool for flat machining has a machine housing, a motor accommodated in the machine housing, a toolholder mounted on the housing, a moveable tool carried by the toolholder and formed as a grinding plate with a triangular base surface for receiving a triangular grinding disk, the toolholder having a substantially triangular base surface substantially corresponding to the base surface of the grinding plate, the toolholder having a region against which the grinding plate is supported and on which the grinding plate is mounted on the toolholder so as to be locked on the toolholder and to be removable from the toolholder without an auxiliary tool.

43 Claims, 8 Drawing Sheets

HAND POWER TOOL FOR FLAT MACHINING

BACKGROUND OF THE INVENTION

The present invention relates generally to hand power tools for flat machining.

One of such hand power tools is disclosed, for example in the British Patent Document GB-A-686 363. U.S. Pat. No. 3,160,995 discloses a hand power tool for grinding surfaces close to edges, in particular in corners or along hollow grooves. The hand power tool has a grinding plate with a triangular base surface. The working movement is performed about a stationary axis which is arranged perpendicular to the base surface in a reciprocating swinging manner. The axis of the grinding plate extends geometrically near and through a forwardly facing corner. The angle of the corner in the front region of the grinding plate is smaller than 90°, and therefore the grinding plate is usable up to the outermost edge-closed region of corners or hollow grooves for grinding. In a further development of a hand powered tools with the grinding plate having a geometrically centrally extending axis, the edge of the grinding tool is curved as in a bracket iron, for edge-flush grinding at locations which are difficult to access. The base contour of the grinding plate formed as an isosceles triangle with curved side edges has, as all such triangles, three corner angles each smaller than 90°.

Moreover hand power tools with rectangular grinding plates are also known. They have an eccentric drive and perform a gyrating, circulating movement. These hand power tools are known as vibrating grinders, while thereto does not perform on vibrating movement in its accurate sense.

In a further development of the vibrating grinders, eccentric grinders have been developed with non-gyrating, circulating and rotating grinding plate. Its movement is controllable by adjustment of several different working steps.

U.S. Pat. No. 4,782,632 discloses a grinding power tool machine with a rotatable grinding plate which is driven through a bendable shaft. It is covered by a shell-shape stationary protective hood which is supported with its shell-shaped edge on a workpiece to be machined and connected with a dust aspirating device by tubular pipes and a hose for aspiration of the produced grinding dust.

The known hand power tools are efficient, but they are relatively expensive. They require an auxiliary tool for a tool exchange, for example for exchange of the grinding plates. Since such an auxiliary tool, for example a screwdriver, is not a always available and is easy to be lost, the exchange of the grinding plates is complicated and time consuming.

SUMMARY OF THE INVENTION

Accordingly, it is an object of the present invention to provide a hand power tool which avoids the disadvantages of the prior art.

In keeping with these objects and with others which will become apparent hereinafter, the present invention resides in a hand power tool for a flat machining, having a housing accommodating a motor, a rotating, circulating or vibrating tool carried by a toolholder and formed as a grinding plate with a triangular base surface for receiving triangular grinding plates, wherein in accordance with the present invention the toolholder is formed with a base surface or contour which substantially corresponds to the contour or the base surface of the grinding plate and is in particular triangular, and the toolholder can be shell-shaped and abuts preferably with its outer edge region against the grinding plate which is locked on the toolholder so as to be removable from the toolholder without an auxiliary tool.

When the hand power tool is designed in accordance with the present invention, it has the advantage that the tool can be quietly and quickly exchanged, in particular the grinding plate together with a grinding plate, without an auxiliary tool, and it is characterized by a simple mounting and unlocking, for example for reversing and cleaning of the grinding plate. In order to provide these advantages, the toolholder must not necessarily be shell-shaped.

In accordance with a further feature of the present invention, a locking is simplified especially by a control button which operates as an overarresting means for mounting the grinding plates, to release the grinding plate from the toolholder. The mounting and removal is especially time-economical when the toolholder at the side opposite to the control button has at least one engaging opening, and at least one projection-shaped supporting claw of the grinding plate engages in it, while the control button has a locking bar elastically displaceable against a pressure spring to provide securing against release and in its elastically held end position fixes the grinding plate. Thereby with low expenses, easily operable, quickly removable, hinge-like fixed holding of the grinding plate on the toolholder is ensure.

The reliable hold of the grinding plate in the region of the locking bar is provided when the locking bar engages an arresting hook on the grinding plate at the side facing the toolholder. The grinding plate is reliably held with pretensioning on the toolholder when, in addition to at least one arresting hook, a one-piece supporting element formed in particular as a supporting claw is provided and supported on the toothholder, and the toothholder at the side facing the grinding plate, for example near an engaging opening for the supporting claw of the grinding plate, carries projections and supporting inclines supported relative to the grinding plate, in particular to its supporting claw, in a pre-tensioned manner.

Any desirable mounting position of the grinding plate on the toolholder, which is pre-tensioned and turnable by 120° is provided when in accordance with the present invention one arresting hook and two supporting claws are arranged in each corner of the grinding plate.

The integrated construction of the toolholder together with the vibrating elements is provided when the toolholder at the side facing away from the grinding plate carries a one-piece elastic vibrating elements which secure the toolholder from the co-rotating and from loosening on the machine housing. Therefore an especially efficient manufacture of the toolholder together with the vibrating elements is provided.

At least two vibrating elements are arranged on the toolholder, so that one vibrating element is arranged in the front corner and another vibrating element is arranged near the side edge of the toolholder opposite to this corner, and the rear vibrating element is formed as a pair composed of three individual vibrating columns while the front vibrating element of four individual vibrating columns connected with one another by upper and lower transverse sheets and the upper transverse sheets of the vibrating elements are inserted in recesses of the machine housing in a form-locking manner. In this construction, with respect to the kinematic of the working movement, especially advantageous guidance of the toolholder with the grinding plate during operation of the hand power tool in particular for corner grinding is provided.

The dust passage between the grinding plate and the toolholder in each mounting position of the grinding plate is guaranteed to be of the same high efficiency by forming an intermediate chamber between the grinding plate and the toolholder. The intermediate chamber is substantially tight up to the dust aspiration openings and a mouth of a dust aspiration passage outwardly, and serves for a passage of the aspirated dust.

The dust aspiration allows undisturbed observation of the workpiece by providing on an outer side of the toolholder a central, in particular rectangular, opening of a dust transporting passage.

The path for the dust aspiration from the workpiece to the passage outlet is short and flow-favorable in the inventive construction, in which the opening is connected with the machine housing by a bellows which in particular is rectangular. Moreover, the bellows can be easily mounted by plugging between the toolholder and the machine housing and operates as an additional vibrating-damping element for the toolholder and for the grinding plate.

Because of the control button and the hinge-like suspension of the grinding plate on the rear part of the toolholder, the grinding plate can be exchangeable simply and quickly by other tools with the same clampable mounting structure corresponding to the toolholder, such as for example a scraper, a saw blade, a separating plate, etc. without an auxiliary tool.

In order to provide a free observation of the workpiece, the grinding plate with the mounted toolholder is raised over the base surface as a truncated pyramid. Vibratings of the hand power tool during grinding are reduced with low expenses when in accordance with the present invention the eccentric pin carries a compensating mass between the lower roller bearing and the toolholder.

The toolholder with the triangular base surface or contour substantially corresponding to the base surface of the grinding plate is shell-shaped and is supported with its outer edge on the grinding plate. For this reason an especially light, material-saving construction of the toolholder is provided. The shell-shape forms a hollow intermediate chamber with respect to the grinding plate, to which the aspirated grinding dust can pass easily and which can accommodate the components including the control button as well as holding means of the grinding plate.

The grinding plate and the toolholder are symmetrical and the grinding plate with its corners is lockable and/or arrestable with any corners of the toolholders. Therefore it is possible to reposition the grinding plate fast and accurately relative to its initial position by turning over 120° so that during subsequent grinding action of the first corner region of the grinding plate and the grinding plate, for example in condition of wear or dirtying, its second and third corner region is usable instead of the first or second corner regions for further corner grinding, and the corner is always oriented exactly forwardly.

Since the grinding plate is a wear part, the fast repositioning of the corner regions relative to the toolholder or the easy exchange of the grinding plate are very important advantages. The advantages are provided by the cooperation of the or resting means of the grinding plate with the arresting means of the toolholder. For this purpose both the toolholder and the grinding plate are provided with inventive features, so that the toolholder is an important component or replacement part with which differently equipped grinding plates or other tools can be releasable or lockable for exchange or conversion without an auxiliary tool.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
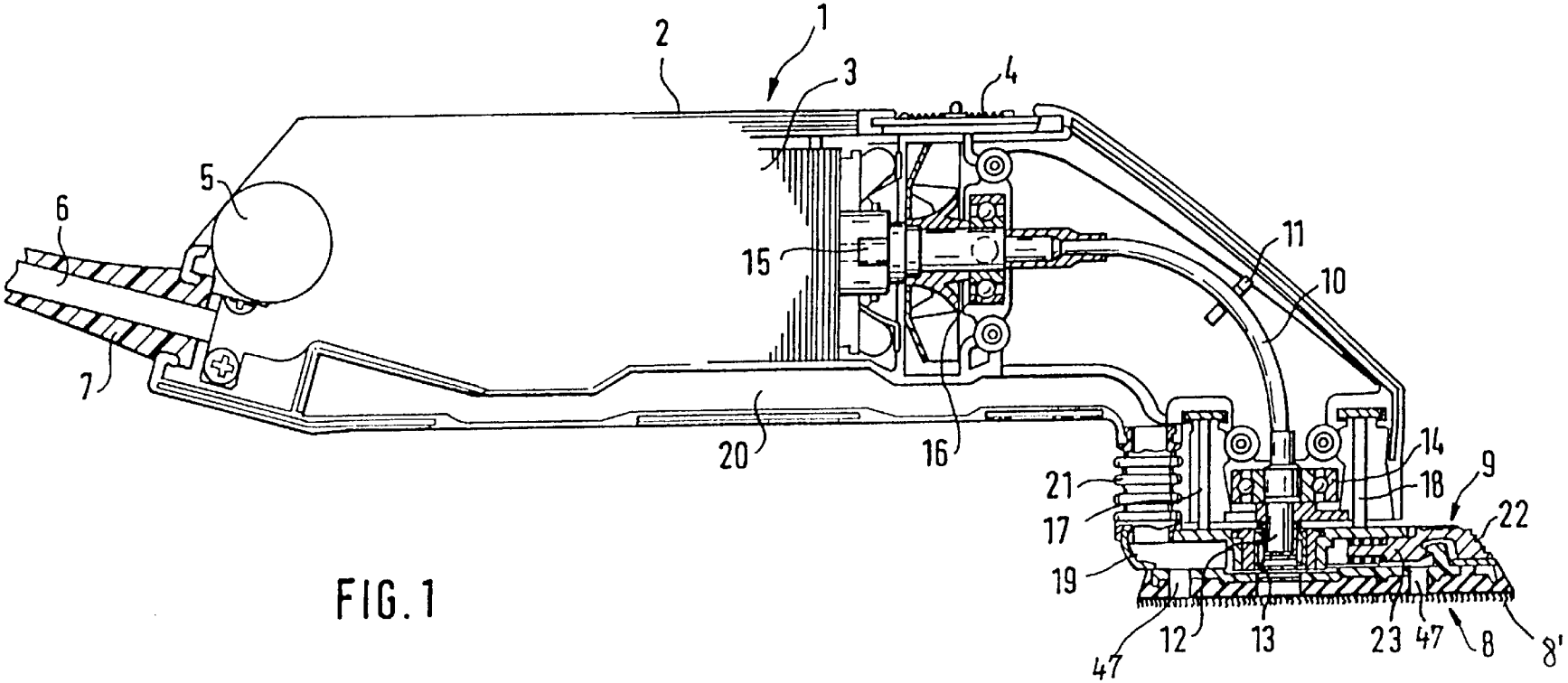
FIG. 1 is a side view of a hand power tool in accordance with the present invention.

A electric hand power tool shown in FIG. 1 is formed as an vibration grinder-1. The ostillation grinder 1 has a machine housing 2 accomdating a motor 3. An on-off switch 4 is located on top of the vibration grinder 1, in particular for activation by a thumb. An adjusting wheel 5 for a motor control is arranged in the rear region of the machine housing 2. An electric connecting conductor 6 with a protective hood 7 extends rearwardly from the machine housing 2. A grinding plate 8 with a Velcro structure 8' is located forwardly on the vibration grinder 1 for receiving of not shown grinding disks which are removably mounted on a toolholder 9 in arresting manner.

A rotation of the motor 3 is transmitted to the toolholder 9 and thereby to the grinding plate 8 through a bendable shaft 10. The shaft is guided by a lateral vibration limiting element 11 in the machine housing 2. The bendable shaft 10 ends at its one end in an eccentric support 120 which carries an eccentric pin 12 and is rotatably supported through a needle bearing 13 on the toolholder 9 and through a lower roller bearing 14 on the machine housing 2 near the toolholder 9 and faces the toolholder. At the side which faces away from the toolholder 9, the bending shaft 10 is coupled through a plug coupling 15 with a not shown motor shaft.

Moreover, the bendable shaft 10 is rotatably supported near the plug coupling 15 through an upper roller bearing 16 in the machine housing 2.

The toolholder 9 is reliably mounted on the machine housing 2 against loosening and against co-rotation through two sheet spring-like vibrating elements 17, 18. The vibrating element 18 is arranged at the front corner and the vibrating element 17 is arranged near the side edge of the tool holder 9 opposite this corner.

A bellows 21 is arranged between a mouth 19 for a dust discharge on the toolholder 9 and a dust transporting passage 20 in the machine housing 2. It is formed as an elastic connecting element. Dust flows through the bellows 21 unobjectionally during the circulating movement of the toolholder 9. It is aspirated through dust aspirating openings 47 of the grinding plate 8 from a workpiece.

Figure 2:
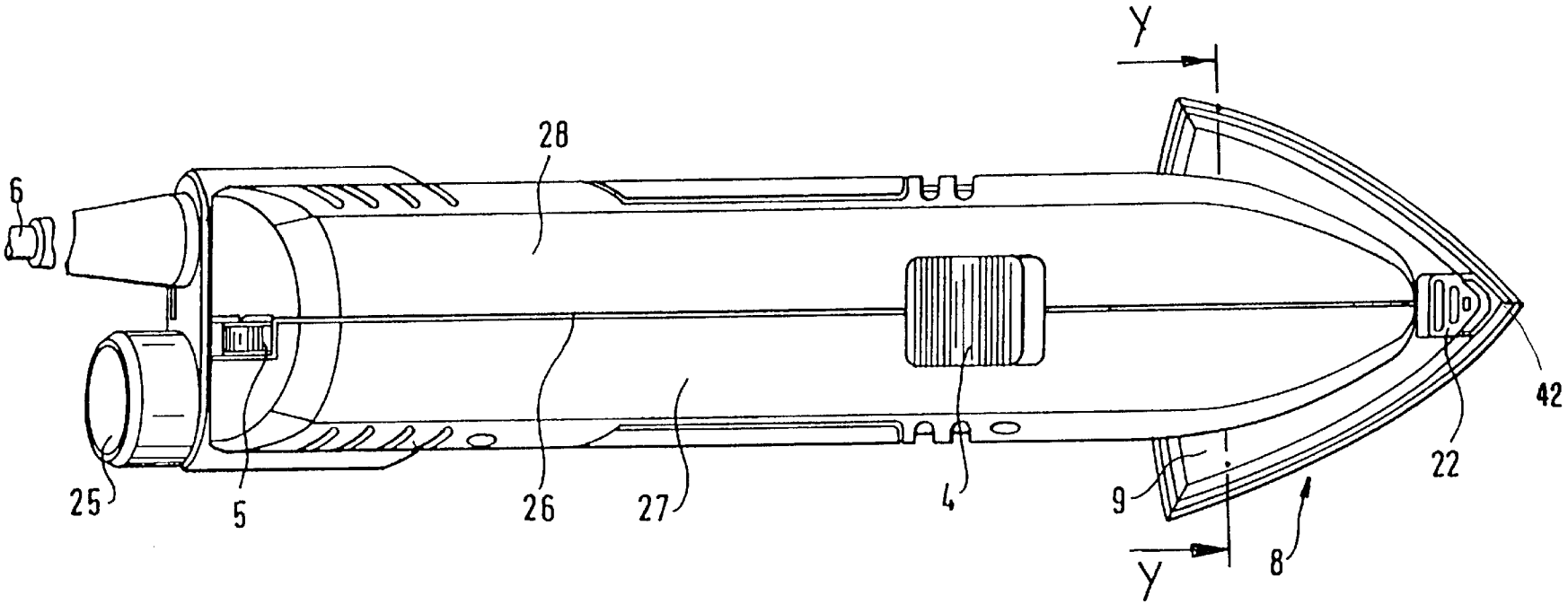
FIG. 2 is a plain view of the hand power tool in accordance with the present invention.
Figure 3:
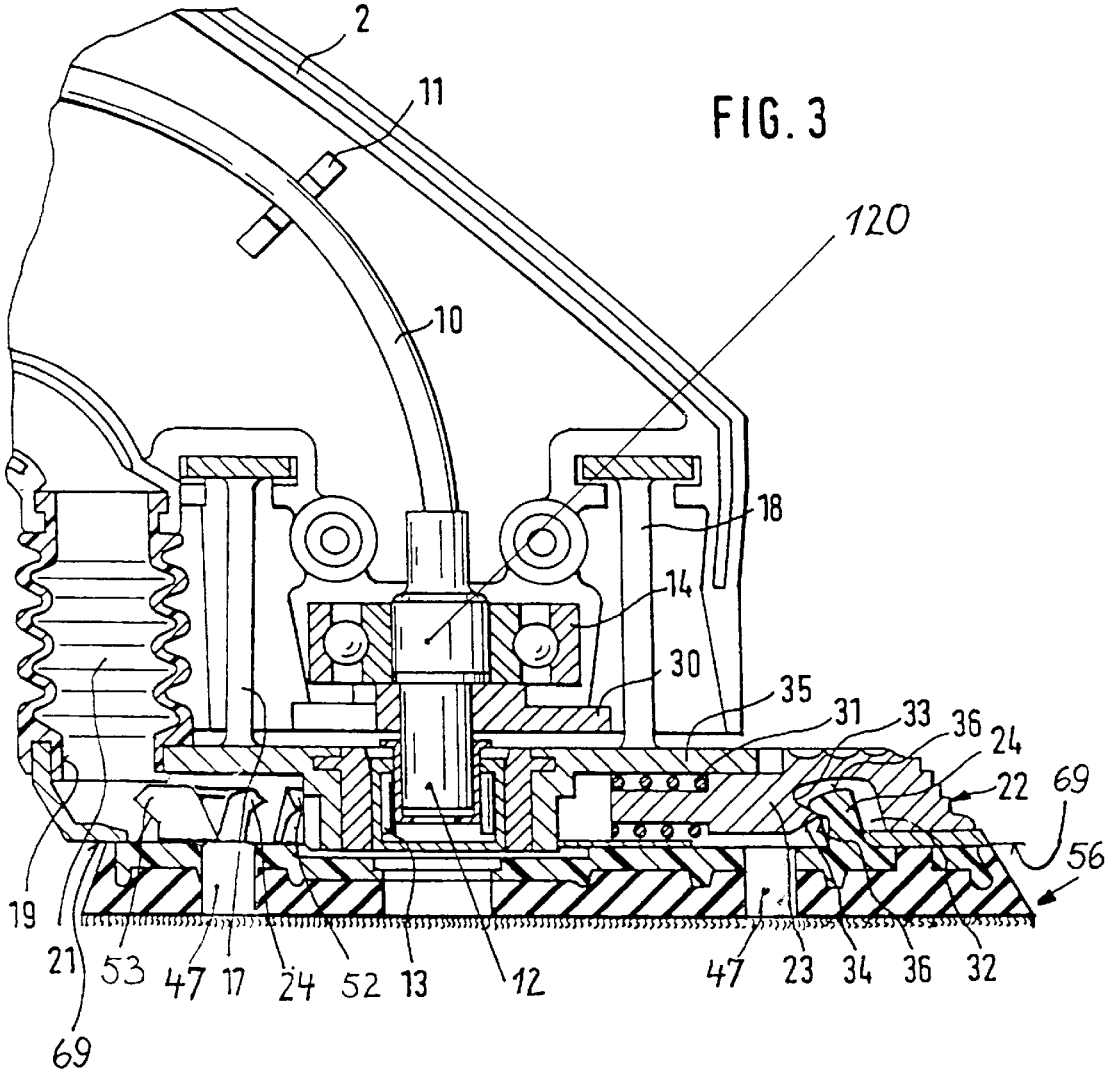
FIG. 3 is an enlarged portion of the front region of the hand power tool of FIG. 1.

The toolholder 9 carries an operation button 22 arranged in the region of the front corner 42 in FIG. 2 and easily accessible from the front and from above. It is displaceable rewardly and connected of one-piece with a locking bar 23. The locking bar 23 as shown in FIG. 3 engages in an arresting hook 24 of the grinding plate 8 and thereby holds the grinding plate 8 on the toolholder 9.

Figure 15:
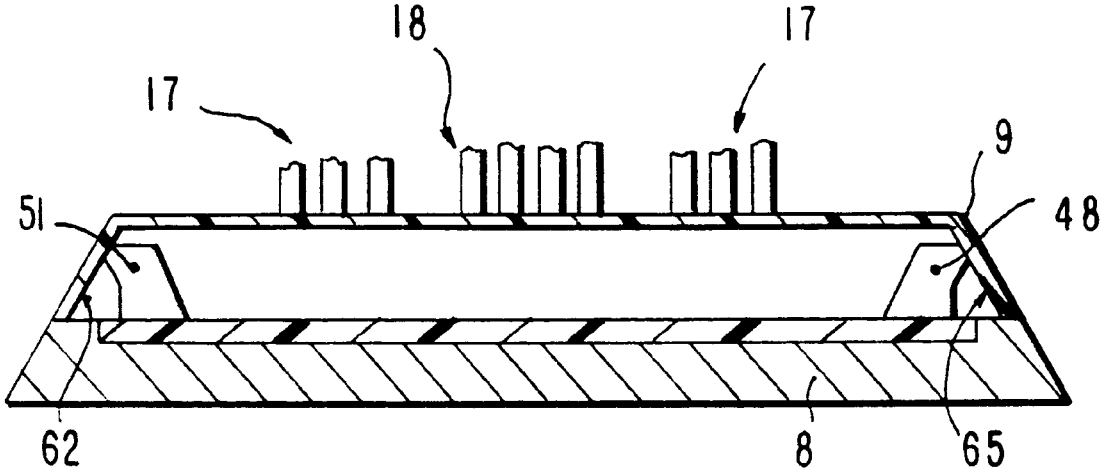
FIG. 15 is a view showing a cross-section of the grinding tool and the toolholder taken along the line Y—Y in FIG. 2.

FIG. 2 shows in detail on the view from above the corresponding components including the operating button 22, the triangular toolholder 9 with the grinding plate 8, the on-off switch 4, the electrical connecting conductor 6, and the adjusting wheel 5 for motor control. Starting from the showing of FIG. 1, FIG. 2 only shows a passage outlet 25 as well as a separating joint 26 of the machine housing 2 composed of two symmetrical half shells 27, 28. It can be seen that the toolholder 9 has a base surface or contour corresponding to those of the grinding plate. It reduces upwardly in the form of a truncated pyramid, so that during grinding a free observation of the not shown workpiece in the corner regions and lateral edges of the grinding plate 8 is possible. FIG. 15 shows a view in correspondence with the section line Y—Y through the rear region of the tool holder 9 and the grinding plate 8.

FIG. 2 shows the components including the machine housing 2, the tool holder 9, the grinding plate 8 with the dust vibrating openings 47, the bendable shaft 10, the rear and front vibrating elements 17, 18 elastically holding the toolholder 9 with the grinding plate 8 relative to the machine housing 2, the bellows 21, the lower roller bearing 14 and the eccentric pin 12 arranged on the eccentric support 120. FIGS. 1 and 2 show a needle bearing 13 between the toolholder 9 and the eccentric pin 12 as well as a compensating mass 30 arranged on the eccentric pin 12 for reducing the unbalance occurring during the eccentric movement of the toolholder 9 with the grinding plate 8. Moreover, a lower, outer edge 69 of the toolholder 9 can be clearly seen, against which the grinding plate 8 abuts. Therefore, a hollow chamber or an intermediate chamber is formed between the toolholder 9 and the grinding plate 8. The aspirated grinding dust can easily pass through the hollow chamber, and the components including the operating button 22 as well as holding or arresting means 24, 48, 49, 50, 61, 52, 53 of the grinding plate 8 shown in FIGS. 8, 9 can be accommodated in it. Moreover, this drawing shows a front grinding plate corner 58 and the supporting claws 52, 53 with the arresting hook 24 arranged in the rear region. The arrangement on the grinding plate 8 and the operation will be explained with reference to the subsequent FIGS. 8, 9 and 15.

The operation button 22 is supported rearwardly displaceably against the force of a pressure spring 31. At the side facing the grinding plate 8, the operation button 22 has a recess 32 with a laterally left contour provided with two inclined surfaces 33, 34 which form a scraper-like tip. This tip is located opposite to a similar tip of an arresting hook 24 which is formed of one piece from a solid grinding plate 35. The arresting hook 24 carries two counter inclines 36, 37. The upper inclined surface 33 of the locking bar 33 or the operation button 22 is hooked and pre-stressed. It engages the arresting hook 24 opposite to the lower counter incline 34 and stabilizes the locking of the grinding plate 8 on the toolholder 9. Therefore, in the clamped condition the grinding plate 8 is firmly pressed against the toolholder 9. Moreover, by the action of the lower inclined surface 34 during mounting of the grinding plate 8 on the toolholder 9, the operation button 22 must not be displaced rearwardly since the arresting hook 24 slides on the locking bar 23 and it is displaced back automatically and arrested. For releasing the grinding plate 8, the operation button 22 is displaced rearwardly, so that the locking bar 23 is moved relative to the arresting hook 24 from the arresting position so far that their tips are released from one another. The grinding plate can now turn about the rear edge in the region of the engaging openings 39, 40 in FIG. 4 relative to the toolholder 9 and can be withdrawn. Therefore an unauthorized release of the grinding plate 8 is prevented by the position of the operation button 22 integrated in the toolholder 9 and offset back, and by its restoring spring 31.

Figure 4:
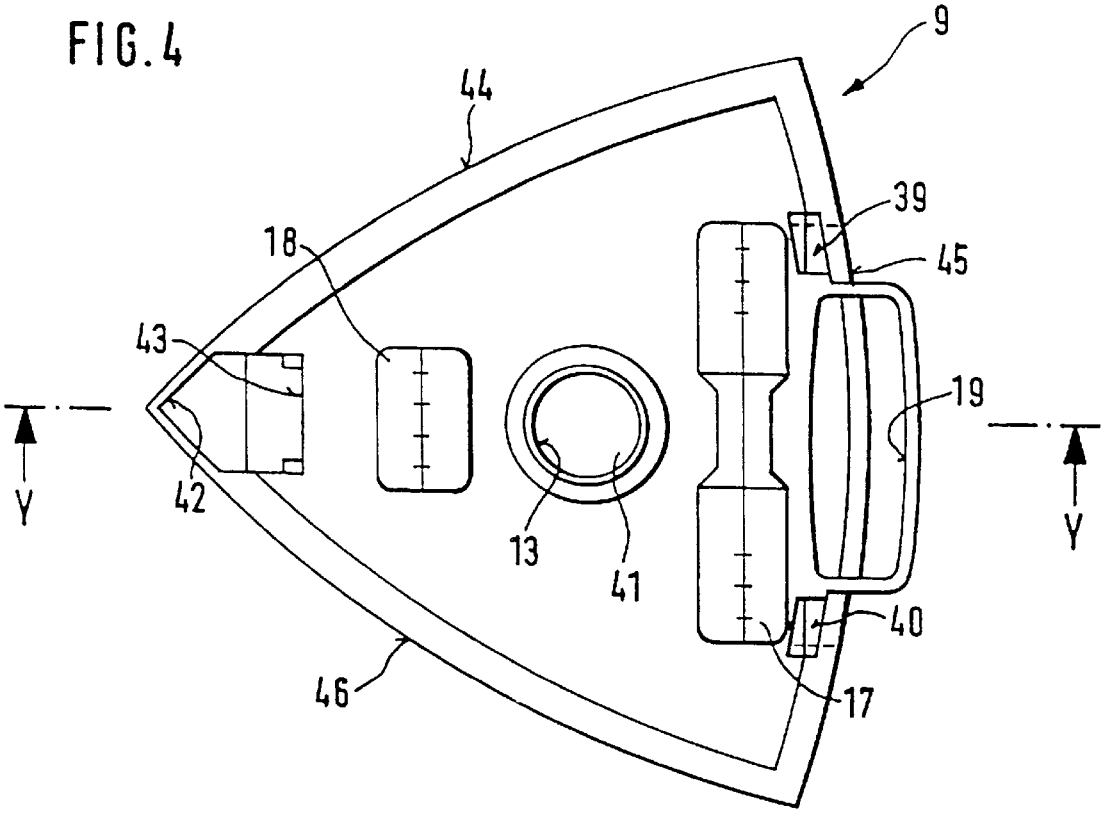
FIG. 4 is a plan view of a toolholder of the inventive hand power tool.

FIG. 4 shows the plan view on the toolholder 9 with the vibrating elements 17, 18 and the mouth 19 of the dust aspirating passage 20, as well as with two engaging openings 39, 40 for engagement of the supporting claws 48, 49, 50, 51, 52, 53, with which the grinding plate 8 is held on the toolholder 9. Furthermore, it shows the opening 41 for engagement of the needle bearing 13 as well as for the eccentric pin 12, and also the opening 43 in the front corner 42 for receiving the operation button 22.

Figure 5:
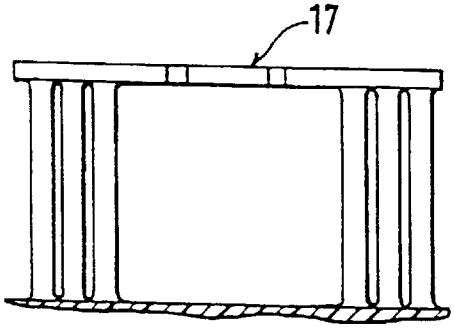
FIGS. 5 and 6 are views showing vibrating elements of the toolholder of the inventive hand power tool of FIG. 4.
Figure 6:
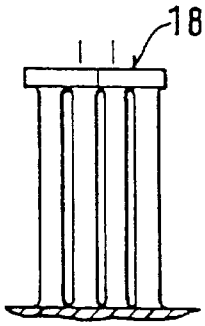
Figure 7:
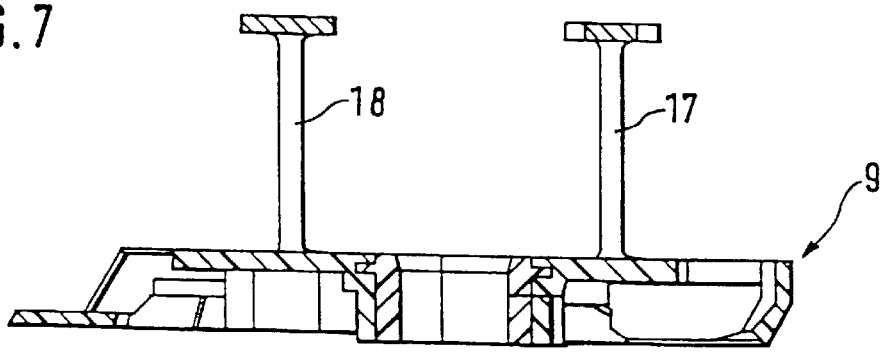
FIG. 7 is a side view of the vibrating element shown in FIG. 7.

The vibrating elements 17, 18 are shown in FIGS. 5 and 6 as an individual unit. It can be seen that the rear vibrating element 17 has a pair of three individual vibrating columns, while the front vibrating element 18 is composed of four individual vibrating columns. FIG. 7 illustrates the arrangement of the vibrating elements 17, 18, on the toolholder 9. In the side view of FIG. 4 along the section line of the arrow Y—Y, it shows the T-profile of the vibrating elements 17, 18 which are arranged with their upper transverse sheet in the corresponding not shown recesses of the machine housing 2 in a form-locking manner.

Figure 8:
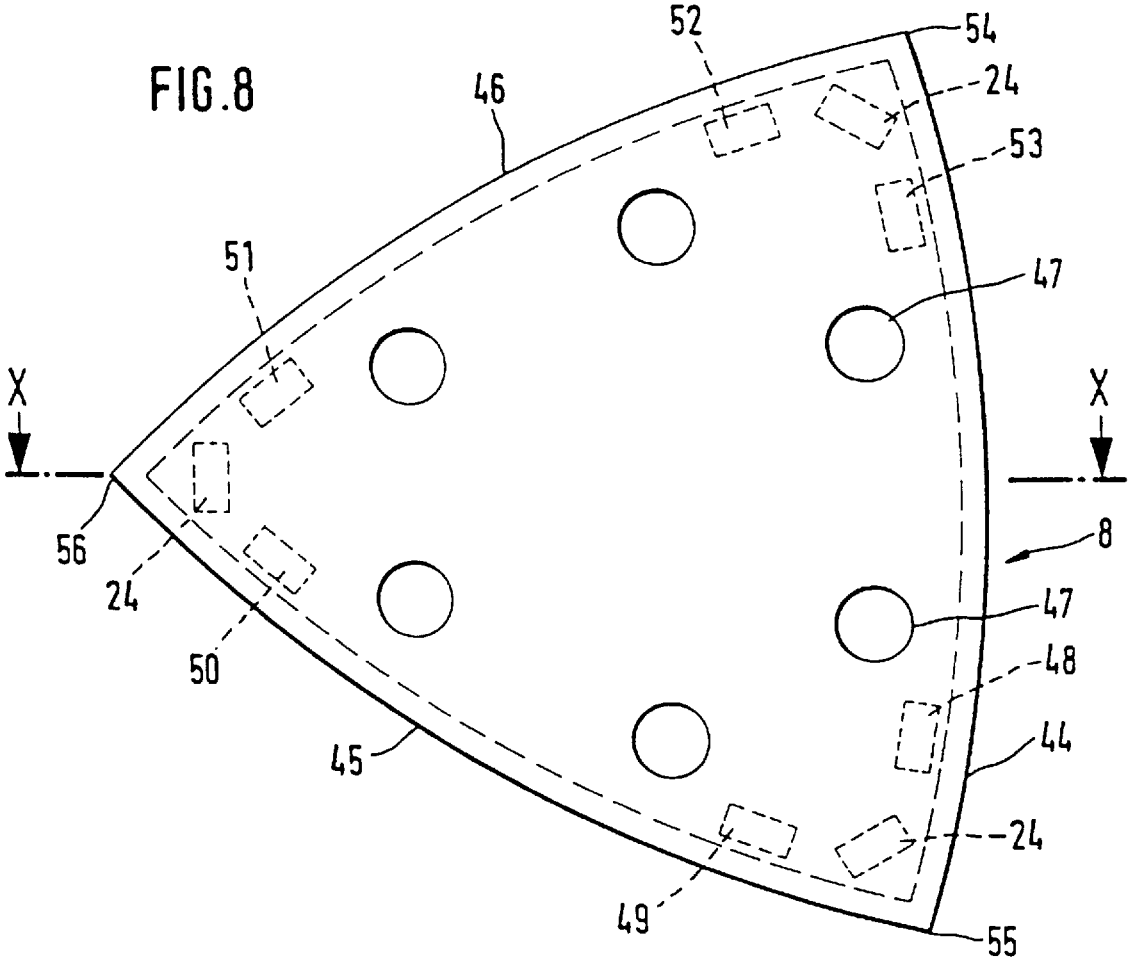
FIG. 8 is a view of the grinding plate of the inventive hand power tool from below.
Figure 9:
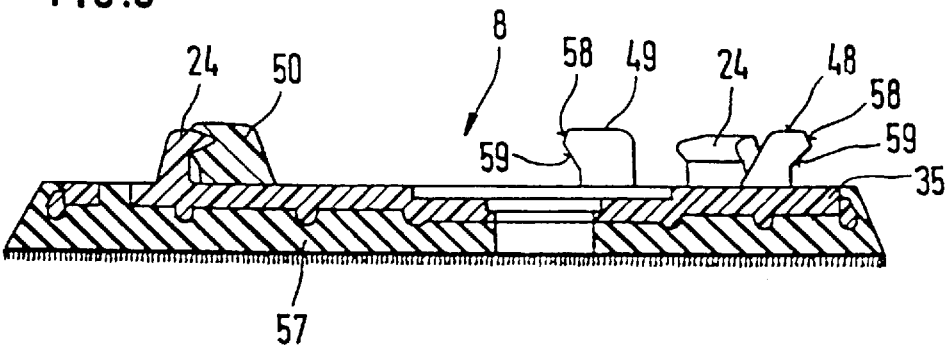
FIG. 9 is a side view of the grinding plate of FIG. 8, in a section.

FIG. 8 shows a view from below of the grinding plate 8 and clearly illustrates its triangular base contour with the outwardly curved side edges 44, 45, 46. Moreover, it clearly shows the arrangement of the aspirating opening 47 on a joint partial circle. FIG. 9 clearly shows the supporting claws 48, 49, 50, 51, 52, 53 and the three arresting hooks 24 near the grinding plate corners 54, 55, 56. The arrows X—X show the section course for FIG. 9.

FIG. 9 shows the side view of the grinding plate 8 along the arrow 10—10 of FIG. 8. It can be seen that the grinding plate 8 has a grinding plate panel 35 composed in particular of a rigid synthetic plastic material, and a grinding plate pad 57 composed in particular of a soft-elastic synthetic plastic material. A Velcro connecting system 57' is carried on the lower side of the grinding plate 8 and has hooks engageable with velour backs of the not shown grinding plate or another tool. The grinding plate panel 35 at its side facing the tool holder has two mirror-symmetrical opposite supporting claws 48, 49, 50, 51, 52, 53 arranged in each grinding plate corner 54, 55, 56 and an arresting hook 24 symmetrically separated by the angle bisecting line. The supporting claws have inclined supporting and holding surfaces 58, 59 which extend to a tip and face outwardly. The arresting hooks 24 have counter inclines 36, 38 extending to a tip and facing inwardly to the center of the grinding plate 8. They are provided for arresting the locking bar 23 of the operation button 22 shown in FIG. 23.

The grinding plate 8 has a completely symmetrical construction and therefore can be associated with the grinding plate corners 54, 55, 56, relative to any corners of the tool holder. The functions of the supporting claws 48, 49, 50, 51, 52, 53 are exchangeable depending on whether they arrest the rear engaging opening 39, 40 of the toolholder 9 arranged opposite to the operation button 22 and therefore hingedly hold the grinding plate 8 on the toolholder 9, or the supporting claws 48, 49, 50, 51, 52, 53 operate as elastic spacer springs to slide on the supporting inclines 62, 63, 64, 65 of FIG. 12 and to firmly prestress the grinding plate 8 relative to the toolholder 9.

Figure 10:
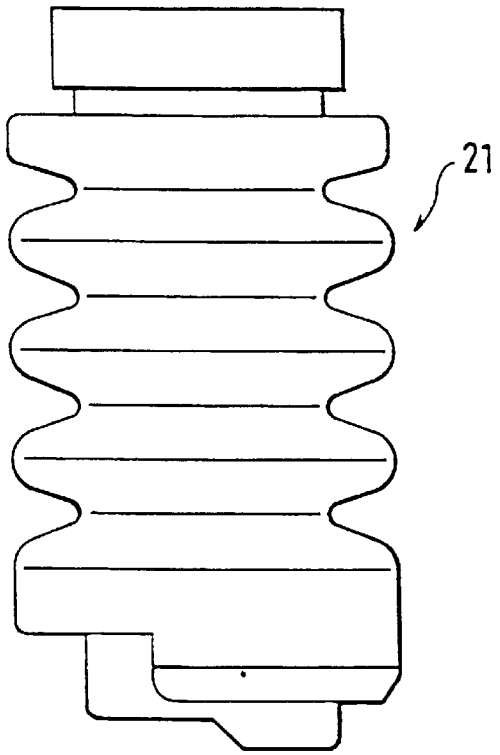
FIG. 10 is a view showing a bellows coupled with the toolholder of the inventive hand power tool for dust aspiration.

FIG. 10 shows an enlarged view of the bellows 21 of FIGS. 1 and 3. As can be seen from this Figure, the bellows 21 has a flat, rectangular cross-section corresponding to the shape of the mouth 19 shown in FIG. 4.

Figure 11:
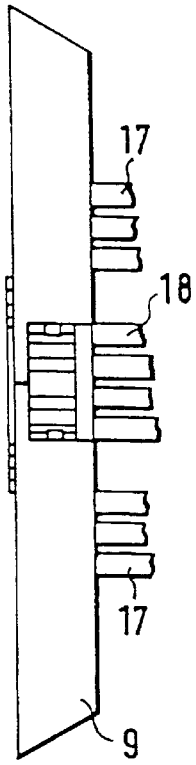
FIG. 11 is a side view of the toolholder from the side of the bellows.
Figure 12:
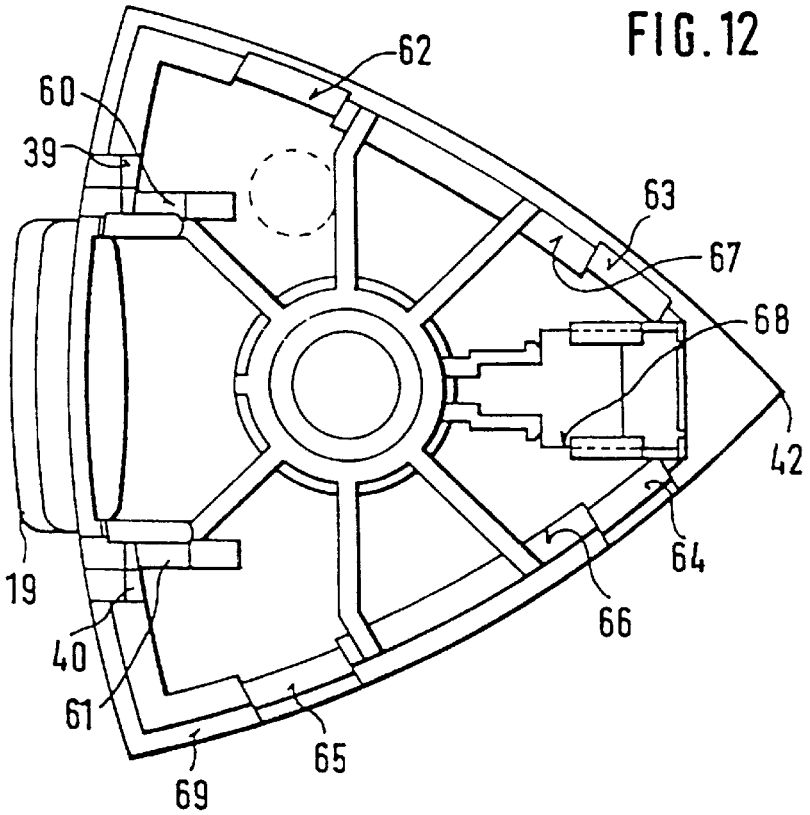
FIG. 12 is a view of the toolholder of the inventive hand power tool from below.

FIGS. 11 and 12 show a view of the toolholder 9 from behind and from below. The symmetrical arrangement of the vibrating elements 17, 18 which is not shown in FIGS. 4–7 can be clearly seen in FIGS. 11 and 12. Moreover, these figures show the projections 60, 61 on which the supporting claws 48, 49, 50, 51, 52, 53 abut and a play-free prestressed mounting of the grinding plate 8 on the toolholder is provided.

The supporting inclines 62, 63, 64, 65 which are arranged on the side surfaces 66, 67 of the toolholder 9 have the same objective. During mounting of the grinding plate 8 they slide on the supporting claws 48, 49, 50, 51, 52, 53 for a pre-stressing between the grinding plate 8 and the toolholder 9 to provide a play-free arrangement. Furthermore, the displacing guide 68 for receiving the operation button 22 can be seen from below.

Figure 13:
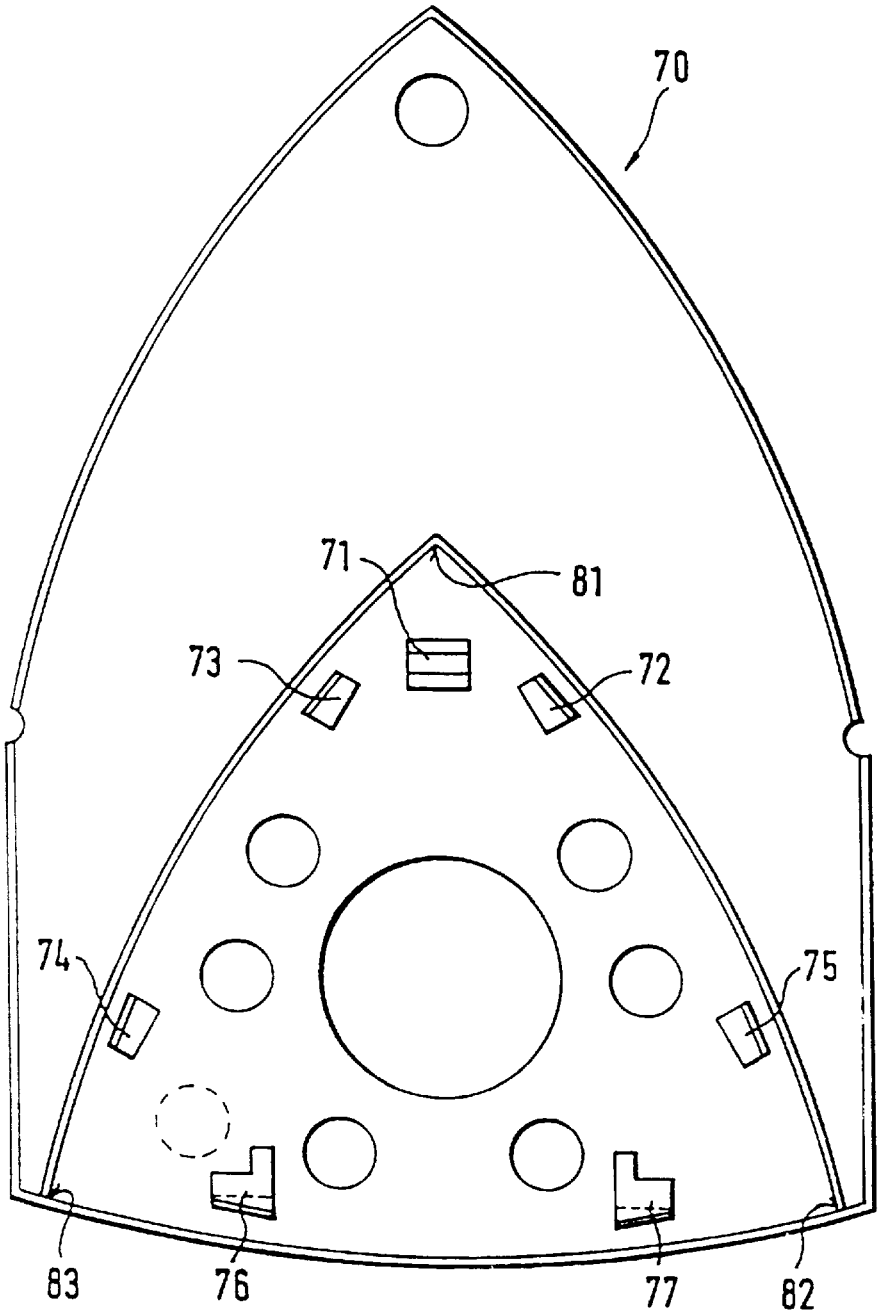
FIG. 13 is a plan view of a grinding plate in accordance with a further embodiment of the invention.
Figure 14:
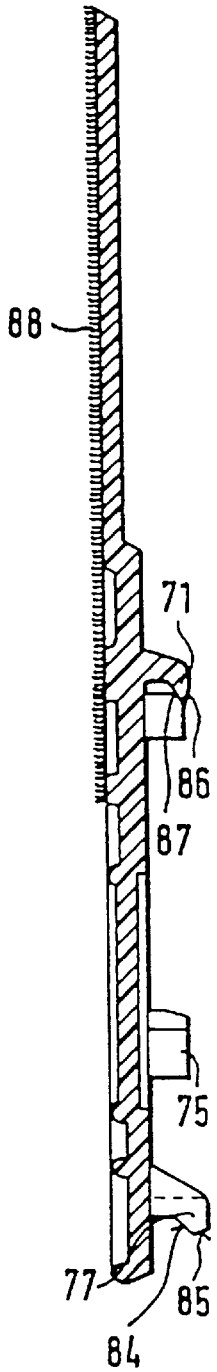
FIG. 14 is a side view of the toolholder of FIG. 13.

A special grinding plate as shown in FIGS. 13 and 14 Analogously to the grinding plate 8 of FIGS. 8, 9 the special grinding plate 70 at its side facing the toolholder 9 carries in each inner contour corner 81, 82, 83 mirror-symmetrical opposite supporting claws 72, 73, 74, 75, 76, 77 and an arresting hook 71 which is symmetrically separated by a longitudinally extending angular bisecting line. The supporting claws 72, 73, 74, 75, 76, 77 have outwardly facing, scrapper-like inclined supporting and holding surfaces 48, 85. The arresting hook 71 has inner opposite inclines 86, 87 facing the center of the grinding plate 70 and provided for arresting the locking bar 23 of the operator button 22 shown in FIG. 3.

The grinding plate 70 because of its asymmetrical construction can be coupled with the toolholder 9 only in a longitudinal direction, since only its forwardly extending region is provided for grinding and not, as in the embodiment of FIGS. 8, 9 the region located directly under the toolholder 9. This figure clearly shows the arrangement of the forwardly displaced Velcro connection region 88. The grinding tool of FIGS. 13, 14 allows grinding in narrow intermediate spaces, for example lamellas of window frames, doors, or for example heating body ribs adjoining one another closely.

The cross-section of the toolholder 9 with the grinding plate 8 along the section line Y—Y in FIG. 2 is shown in FIG. 15. It can be seen that the toolholder 9 has a shell-like design and the supporting claws 48, 49 abut in a prestressed and play free manner against its supporting inclines 62, 65 in the rear region of the grinding plate 8 or the toolholder 9. In the same way the supporting claws 48, 49 abut in the not shown region of the front grinding plate corner 56 at both sides of the front arresting hook 24 against the not shown supporting claws 50, 51 on the not shown supporting inclines 63, 64 as can be seen from a comparison with FIGS. 8, 9, 12.

When the motor 3 is switched on by the on-off switch 4, the motor shaft is rotated and rotates the flexible shaft 10 with the eccentric support 120 and the eccentric pin 12. The toolholder 9 which is secured by the vibrating elements 17, 18 in the machine housing at a safe distance from turning and bending performs an elliptic circulating movement and it follows the eccentric pin 12. Since the elliptic movement is performed longitudinally forwardly, the curved outer edges 44, 45, 46 of the grinding plate 8 or the grinding plate can provide especially good machining of edges or hollow grooves or other regions which are difficult to access on workpieces flush and close to edges.

The grinding plate 8 which is releasable without an auxiliary tool by the operation button 22 can be quickly exchanged by another, not shown grinding plate provided with grinding plates with different grain sizes or exchanged by a special grinding plate 70 shown in FIGS. 13, 14. Time consuming release of the Velcro connection between the grinding plate 8 and the grinding plate is dispensed with since the corresponding grinding plate can remain on its grinding plate. Therefore grinding works with different surface quality can be alternatingly performed in a convenient manner. The extension of the grinding plate 8 and/or the toolholder 9 over its base surface in the shape of a truncated pyramid provides good observation of the surfaces or edges to be machined and control of the vibrating grinder 1. The outer edges of the grinding plate are always located in the field of observation of the user of the vibrating grinder.

The passage outlet 25 for withdrawal of grinding dust and the like is located asymmetrically at the rear end of the machine housing 2 in a shell half 27 of the housing. Therefore the passage outlet 26 can be produced with high accuracy so that hoses or similar elements for dust withdrawn can be connected in especially tight manner to secure them from un intentional loosening.

In a not shown embodiment of the invention, instead of the grinding plate 8 or 70 of FIGS. 8 or 13, a correspondingly adopted separating plate can be clamped, analogously to the mounting of the known grinding plate. With this separating plate, floor coatings and carpets can be easily released from a substrate. In accordance with another not shown embodiment of the invention, instead of a grinding plate, a scrapper and/or saw can be used on the toolholder.

In accordance with still a further embodiment of the present invention, the toolholder with the tool plate is supported in an arrestable hinge on the machine housing, so that the grinding plate plane or the like can be turnable for adjustment of the vibration grinder to angled workpieces which are difficult to access.

We claim:

1. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said toolholder having a region against which said grinding plate is supported and on which said grinding plate is mounted on said toolholder so as to be locked on said toolholder and to be removable from said toolholder without an auxiliary tool, said toolholder being provided with an operation button formed so that when said operation button is actuated, a locking between said grinding plate and said toolholder is releasable without an auxiliary tool and when said operation button is not actuated it operates as an arresting means for fixing said grinding plate on said toolholder.

2. A hand power tool as defined in claim 1; and further comprising a Velcro connection for connecting the grinding plate with said grinding disk.

3. A hand power tool as defined in claim 1, wherein said toolholder is shell-shaped, said region of said toolholder against which said grinding plate is supported is formed as an outer edge region.

4. A hand power tool as defined in claim 1, wherein said toolholder at a side which is opposite to said operation button has at least one engaging opening, said grinding plate having at least one supporting claw engaging in said engaging opening.

5. A hand power tool as defined in claim 1, wherein said operation button has a locking bar displaceable against a spring force on said toolholder, is secured against loosening and holds said grinding plate in an elastic end position.

6. A hand power tool as defined in claim 5, wherein said grinding plate has an arresting hook, said locking bar engage in said arresting hook of said grinding plate.

7. A hand power tool as defined in claim 6, wherein said locking bar engages said arresting hook at a side of said grinding plate which faces said toolholder.

8. A hand power tool as defined in claim 1, wherein said tool holder at a side facing said grinding plate has supporting means against which said grinding plate abuts.

9. A hand power tool as defined in claim 8, wherein said toolholder has an engaging opening, said supporting means being arranged near said engaging opening.

10. A hand power tool as defined in claim 8, wherein said supporting means include projections.

11. A hand power tool as defined in claim 1, wherein said supporting means include supporting inclines.

12. A hand power tool as defined in claim 1, wherein said grinding plate and said toolholder form an intermediate chamber therebetween; and further comprising dust aspirating means including dust aspirating openings and a dust transporting passage, said intermediate space is tight up to said dust aspirating opening and up to a mouth of said dust transporting passage and operates for passage of an aspirated dust.

13. A hand power tool as defined in claim 12, wherein said toolholder has an outer side on which said mouth of said dust transporting passage is arranged, said mouth being rectangular.

14. A hand power tool as defined in claim 13, wherein said rectangular mouth is arranged centrally of said outer side of said toolholder.

15. A hand power tool as defined in claim 1, wherein said grinding plate and said toolholder are formed so that said grinding plate is removable from said toolholder and exchangeable by a different tool having a mounting structure corresponding to said toolholder, without an auxiliary tool.

16. A hand power tool as defined in claim 1, wherein said grinding plate and said toolholder are formed as a truncated pyramid raising above said base surface and forming together, flush with one another a truncated pyramid.

17. A hand power tool as defined in claim 1, wherein said toolholder coincides with said base surface of said grinding plate and is shell-shaped and abuts against said grinding plate.

18. A hand power tool as defined in claim 17, wherein said shell-shaped toolholder has an outer edge abutting against said grinding plate.

19. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said toolholder having a region against which said grinding plate is supported and on which said grinding plate is mounted on said toolholder so as to be locked on said toolholder and to be removable from said toolholder without an auxiliary tool, said grinding plate having at least one arresting hook and one-piece supporting means formed as supporting claws and supported on said toolholder so as to secure a position of said grinding plate.

20. A hand power tool as defined in claim 19, wherein said supporting claws secure a position of said grinding plate in a pre-stressed manner.

21. A hand power tool as defined in claim 19, wherein said grinding plate has a plurality of corners, each of said arresting hooks and each of said supporting claws being arranged at each of said corners.

22. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool, said toolholder at a side facing said grinding plate having supporting means against which said grinding plate abuts, said grinding plate having supporting claws abutting against said supporting means.

23. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool, said operating button being spring-elastically displaceable rearwardly and is accessible from one side selected from the group consisting of a front side and an upper side, said grinding plate having arresting means and said toolholder having further arresting means cooperating with said arresting means of said grinding plate, said operation button cooperating with said arresting means of said grinding plate so that in an inoperative position it locks said grinding plate on said toolholder and in a rearwardly displaced position it releases said arresting means of said grinding plate.

24. A hand power tool as defined in claim 23, wherein said arresting means of said grinding plate include arresting hooks and supporting claws, while said arresting means of said toolholder include engaging openings in which said arresting means of said grinding plate engage.

25. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool, said grinding plate being asymmetrical and having a plurality of corners lockable with corners of said toolholder.

26. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool, said grinding plate being asymmetrical and having a plurality of corners arrestable with corners of said toolholder.

27. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool; and an eccentric pin through which said toolholder at a side facing away from said grinding plate is coupled releasably with said motor through said eccentric pin; and one piece elastic vibrating elements which hold said toolholder against co-rotation and loosening on said machine housing.

28. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool; and vibrating elements provided on said toolholder so that one of said vibrating elements is arranged at a front corner and another of said vibrating elements is arranged near a corner of an opposite side edge of said toolholder.

29. A hand power tool as defined in claim 28, wherein said other vibrating element includes several pairs of individual vibrating columns, while said one vibrating element include several individual astulating columns; and further comprising upper and lower transverse plates connecting said individual vibrating columns with one another.

30. A hand power tool as defined in claim 29, wherein said other vibrating element includes three individual vibrating columns, while said one vibrating element includes four individual vibrating columns.

31. A hand power tool as defined in claim 29, wherein said machine housing has recesses, said upper transverse plate of said vibrating elements being form-lockingly inserted in said recesses of said machine housing.

32. A hand power tool for flat machining, comprising a machine housing, a motor accommodated in said machine housing; a toolholder mounted on said housing; a moveable tool carried by said toolholder and formed as a grinding plate with a triangular base surface for receiving a triangular grinding disk, said toolholder having a substantially triangular base surface substantially corresponding to said triangular base surface of said grinding plate, said tool holder having a region against which said grinding plate is supported and on which said grinding plate is mounted on said toolholder so as to be locked on said toolholder and to be removable from said toolholder without an auxiliary tool, said grinding plate and said toolholder forming an intermediate chamber therebetween; dust aspirating means including dust aspirating openings and a dust transporting passage, said intermediate space is tight up to said dust aspirating opening and up to a mouth of said dust transporting passage and operates for passage of an aspirated dust, said toolholder having an outer side on which said mouth of said dust transporting passage is arranged, said mouth being rectangular; and a rectangular bellows, said mouth being connected through said rectangular bellows with said machine housing.

33. A toolholder for a hand power tool having a machine housing; a motor accommodated in a housing, and a movable tool formed as a grinding plate, said toolholder comprising a main body formed to coincide with a base surface of the grinding plate; and means for releasably mounting the grinding plate on said main body and for releasing said grinding plate without an auxiliary tool, said main body having a side arranged to face the grinding plate and is provided at said side with supporting means against which the grinding plate can abut with prestress.

34. A hand power tool as defined in claim 33, wherein said main body is triangular.

35. A hand power tool as defined in claim 34, wherein said main body has a plurality of dust aspirating openings arranged on a joint partial circle.

36. A toolholder for a hand power tool having a machine housing; a motor accommodated in a housing, and a movable tool formed as a grinding plate, said toolholder comprising a main body formed to coincide with a base surface of the grinding plate; and means for releasably mounting the grinding plate on said main body and for releasing said grinding plate without an auxiliary tool, said main body being triangular.

37. A hand power tool as defined in claim 36, wherein said main body is triangular.

38. A hand power tool as defined in claim 36, wherein said supporting means include projections.

39. A hand power tool as defined in claim 36, wherein said supporting means include supporting inclines.

40. A toolholder for a hand power tool having a machine housing; a motor accommodated in a housing, and a movable tool formed as a grinding plate, said toolholder comprising a main body formed to coincide with a base surface of the grinding plate; and means for releasably mounting the grinding plate on said main body and for releasing said grinding plate without an auxiliary tool, said main body being provided with one piece elastic vibrating elements securing said main body from a co-rotation and loosening.

41. A hand power tool as defined in claim 40, wherein said vibrating elements include at least two vibrating elements arranged so that one of said vibrating elements is provided on a front corner and another of said vibrating element is provided near a side edge located opposite to the front corner.

42. A hand power tool as defined in claim 40, wherein said other vibrating element includes several pairs of individual vibrating columns, while said one vibrating element includes several individual vibrating columns; and further comprising upper and lower transverse plates connecting said individual vibrating columns with one another.

43. A hand power tool as defined in claim 40, wherein said other vibrating element includes three pairs of individual vibrating columns, while said one vibrating element includes four individual vibrating columns.

* * * * *